US005402694A

United States Patent [19]

Kelly et al.

[11] Patent Number: 5,402,694

[45] Date of Patent: * Apr. 4, 1995

[54] ROD GRIPPING AND ROTATING TOOL

[75] Inventors: Michael W. Kelly, Joliet, Ill.; Glenn F. Jorgensen, Ridgewood, N.J.

[73] Assignees: Power House Tool, Inc., Joliet, Ill.; JNT Technical Services, Inc., Little Ferry, N.J.

[ * ] Notice: The portion of the term of this patent subsequent to Oct. 19, 2010 has been disclaimed.

[21] Appl. No.: 238,723

[22] Filed: May 5, 1994

Related U.S. Application Data

[63] Continuation-in-part of Ser. No. 53,424, Apr. 28, 1993, Pat. No. 5,372,055, which is a continuation-in-part of Ser. No. 974,945, Nov. 12, 1992, Pat. No. 5,253,556.

[51] Int. Cl.[6] ..... B25B 13/48

[52] U.S. Cl. ..... 81/53.2; 279/43.2; 279/43.4

[58] Field of Search ..... 81/532; 279/43, 43.2, 279/43.4

[56] References Cited

U.S. PATENT DOCUMENTS 2,391,624 12/1945 Heuer ..... 81/53.2

2,798,392 7/1957 Randolph ..... 81/53.2

*Primary Examiner*—James G. Smith

*Attorney, Agent, or Firm*—Hill, Steadman & Simpson

[57] ABSTRACT

A rod turning tool having a first sleeve with at least one open end and having an internal thread and an external tapering with second and third sleeves surrounding the first sleeve and arranged on uphill and downhill sides of the external tapering, the second and third sleeves having compatible taperings on the inside diameters thereof to be flush with the external tapering of the first sleeve, and a plurality of fasteners connecting the second and third sleeves axially. A tightening of the fasteners drawing the second and third sleeves together, sliding along the external tapering which acts to compress the first sleeve against a rod threaded into the internal threads of the first sleeve. In an alternate embodiment, the second sleeve is located against the external tapering and the third sleeve is fixed in axial position by an external flange of the first sleeve and the plurality of fasteners draws the second sleeve toward the fixed third sleeve to compress the first sleeve.

17 Claims, 2 Drawing Sheets

ROD GRIPPING AND ROTATING TOOL

This application is a continuation in part of U.S. Ser. No. 08/053,424, filed Apr. 28, 1993, U.S. Pat. No. 5,372,055, which is a continuation in part of Ser. No. 07/974,945, filed Nov. 12, 1992, and now U.S. Pat. No. 5,253,556, Issued Oct. 19, 1993.

BACKGROUND OF THE INVENTION

The present invention relates to a tool for rotating a rod or post, such as a stud. A threaded rod such as a stud fastener, often times presents an assembly or disassembly problem in that there generally is no gripping surface on such a fastener against which to apply a torque force to rotate the fastener. This is particularly true when there are very close tolerances between the stud fastener and the threaded opening into which it is threaded, requiring a high torque level for rotation of the fastener relative to material into which it is being inserted or from which it is being removed. Occasionally threaded rods, or studs, are placed into working environments wherein corrosive liquids or gases are present causing a locking or seizing to occur between the stud and its surrounding material, increasing the difficulty of removal of the stud.

Various mechanisms have been proposed for assisting in stud removal or inserting. For example, U.S. Pat. No. 4,932,292 discloses a device which could be used to remove a stud. This device employs an arrangement of loose jaws which engage against ramp surfaces to selectively move the jaws radially inwardly to grip a central post when the tool is rotated in one rotational direction. Rotation in an opposite direction will cause the jaws to loosen from the post. Therefore, such a device can be used only to rotate the post in one rotational direction.

It would be an advance in the art if there were provided an easy to use tool, economically manufactured and maintained, for radially rotating a rod in either rotational direction.

SUMMARY OF THE INVENTION

Objects of the invention are to provide a tool for rotating a rod which is easy to use, simply and economically manufactured, rugged and easily maintained and effective in operation.

A tool in accordance with the principle of the present invention comprises three sleeve members. A first sleeve member has an internal passage for receiving the rod or stud. The passage may or may not extend entirely through the first sleeve. The first sleeve has a drive arrangement at a first end for engagement by a torque applying tool such as a wrench. Near a second end, the sleeve has an outside surface flared outwardly from two opposite axial directions to a crest. The sleeve also has a plurality of longitudinal slots extending axially from the second end toward the first end.

This first sleeve is to be slipped onto or threaded onto the rod which is to be rotated. A second sleeve is applied around said first sleeve at said second end and has an internal diameter with a taper to rest substantially flushly against said flared outside surface. A third sleeve is applied between said crest and said first end, said third sleeve having an internal diameter with a taper to rest flushly against the flared outside surface.

The third sleeve and second sleeve have axially arranged and spaced apart bores, the bores of the second sleeve registering with the bores of the third sleeve. The bores of the third sleeve are plain bores and the bores of the second sleeve are threaded bores. A plurality of bolts or machine screws are applied through the bores of the third sleeve and threaded into the bores of the second sleeve. Alternately, both the bores of the second and third sleeve can be plain and a bolt and nut combination can connect the sleeves. Tightening of the bolts draws the second and third sleeves together across the flared outside surface toward the crest. The force of the second and third sleeve sliding across the flared outside surface results in the first sleeve being collapsed inwardly, accommodated by the longitudinal slots.

The collapsing and inward pressing of the first sleeve against the rod greatly increases the frictional engagement between the first sleeve and the rod. Thus, when the first sleeve is rotatably driven, the rod rotates as well. The interior surface of the first sleeve can either be threaded to match the thread of the rod, or can have some other friction enhancing contour such as a series of longitudinal spines or knurls to enhance the frictional engagement between the first sleeve and the rod.

As an alternate to the above described device, the third sleeve, rather than sliding along the flared outside surface can be a rectangular cross-sectional ring with a square cut bore rather than a tapered bore. The first sleeve can be provided with an annular flange and a flared region surrounded by the second sleeve. The flange would be located between the third sleeve and the second sleeve. The third sleeve would thus be supported on the flange and when the cap screws or bolts are drawn tight the second sleeve sliding along the flared region would draw the first sleeve tight against the rod.

DETAILED DESCRIPTION OF THE PREFERRED EMBODIMENTS

Figure 1:
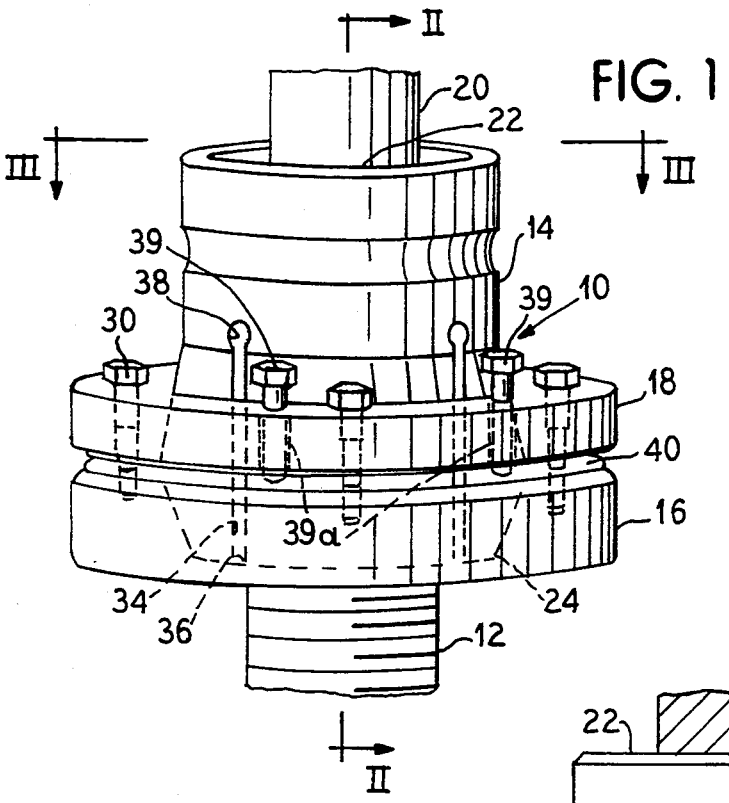
FIG. 1 is a perspective view of a rod rotating tool of the present invention.

FIG. 1 illustrates a rod rotating tool 10 installed onto a threaded rod 12. The rod rotating tool 10 provides a first sleeve 14 surrounded by a second sleeve 16 and a third sleeve 18. A torque tool engaging formation 20 such as a square or polygonal drive stub is attached to the first sleeve 14 at a first end 22 thereof. The second sleeve 16 surrounds the first sleeve 14 at a second end 24 thereof. The third sleeve 18 surrounds the first sleeve 14 between the second sleeve 16 and the first end 22. A plurality of fasteners 30 such as machine screws or bolts are applied between the third sleeve 18 and the second sleeve 16. The first sleeve 14 has formed therethrough a plurality of slots 34 being arranged elongate axially along the first sleeve with open ends 36 at said second end 24 of said first sleeve, and rounded closed ends 38 toward said first end 22 of the first sleeve 14.

A plurality of jack bolts 39 are arranged around the third sleeve threaded into threaded bores **39*a* of the third sleeve. The bolts 39 abut a top surface 40 of the second sleeve 16**. When it is desired to remove the tool 10 from the rod 12, after the fasteners 30 are loosened or removed, the bolts 39 are turned to progress downwardly to effect a forced separation of the second and third sleeve. Alternatively, a wedge can be forced between the second and third sleeve to force separation. The orientation of the tapers 42, 44 provide an operational advantage. It has heretofore been experienced that when the second sleeve, or the sleeve closest to the open end of the first sleeve is tapered outwardly toward the open end to be forced downwardly to collapse the first sleeve, it is difficult to remove the tool after collapsing the first sleeve because to loosen, the second sleeve must be pulled up away from the open end. Thus, the second sleeve must be somehow gripped to be pulled upwardly from the open end. The present invention is advantageous in that due to the orientation of the tapers 42, 44 the second sleeve is pressed toward the open end, away from the third sleeve, to loosen. Thus, a wedge or the jack bolts 39 can be used to easily disengage the tool 10 from the rod 12.

Figure 2:
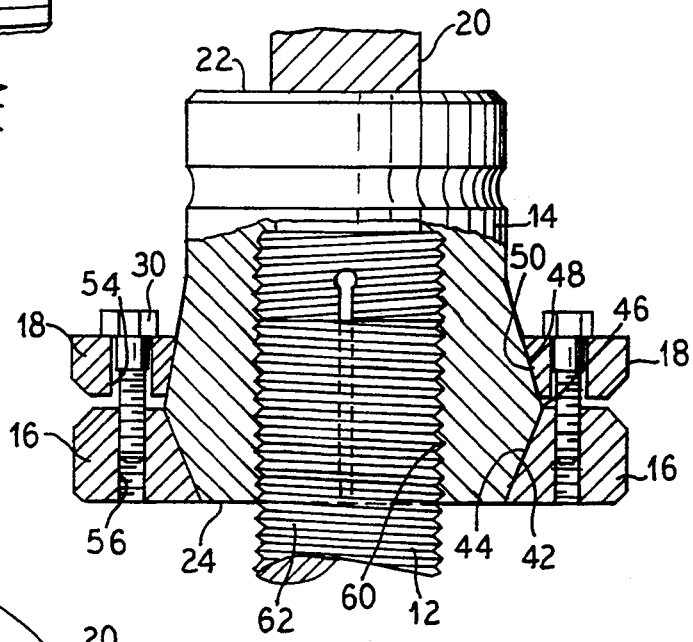
FIG. 2 is a sectional view taken generally along line II—II of FIG. 1.
Figure 3:
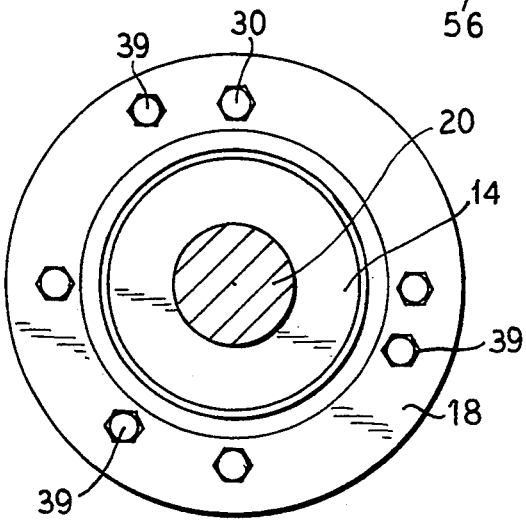
FIG. 3 is a sectional view taken generally along line III—III of FIG. 1.

As illustrated more clearly in FIG. 2, the first sleeve 14 comprises an outward bevel or taper 42 from the second end 24 toward the first end 22. The second sleeve 16 provides a inside diameter taper 44 compatible with the outside taper 42 of the first ring. The outside bevel 42 terminates in a crest 46 located between the second and third sleeves. The first sleeve 14 thereupon has a second bevel or taper 48 from the crest 46 toward the first end 22. The third end ring 18 provides a complementary inside taper 50 to the outside bevel 48. The third sleeve 18 provides plain bores 54 for receiving the fasteners 30, and the second ring 16 provides threaded bores 56 in registry with the plain bores 54. When the fasteners 30 are progressed into the threaded bores 56 the third sleeve 18 and second sleeve 16 are drawn together with the tapered surfaces 44, 50 sliding along the tapered surfaces 42, 48 which imparts a squeezing or collapsing force on the first sleeve 14 which causes a collapsing of the first sleeve 14 accommodated by the plurality of slots 34.

The first sleeve 14 can be provided with an inside thread 60 compatible with an outside thread 62 of the rod 12. The collapsing of the first sleeve 14 causes a great gripping force between the first sleeve 14 and the rod 12. A torque tool can be fit on the protrusion 20 to rotate the assembly 10 and the thus gripped rod 12. Other means of gripping the tool 10 and turning it are known such as disclosed in U.S. Pat. No. 5,253,556, incorporated herein by reference.

Figure 4:
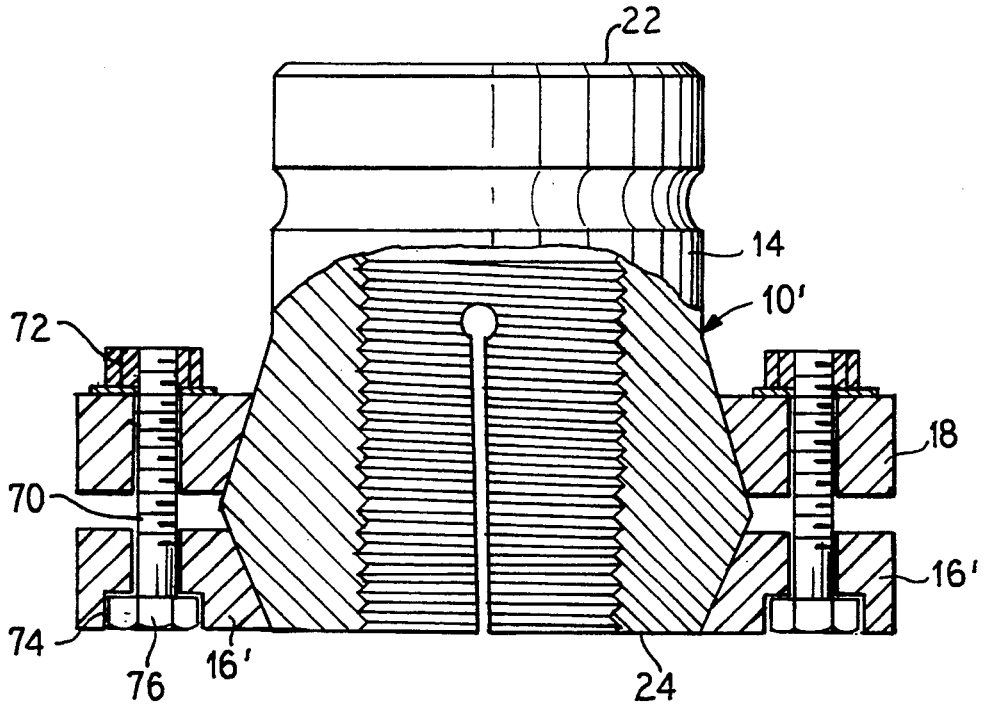
FIG. 4 is a sectional view of an alternate embodiment of the present invention.

FIG. 4 illustrates an alternate embodiment of a 10′ wherein instead of cap screws 30, bolts 70 can be used with nuts 72. A second sleeve 16′ can beneficially provide a polygon cross-section recess 74 for receiving a bolt head 76 of the bolt 70 and preventing the bolt head 76 from turning during the screwing on of the nut 72 to draw the second sleeve 16′ to the first sleeve 18.

Figure 5:
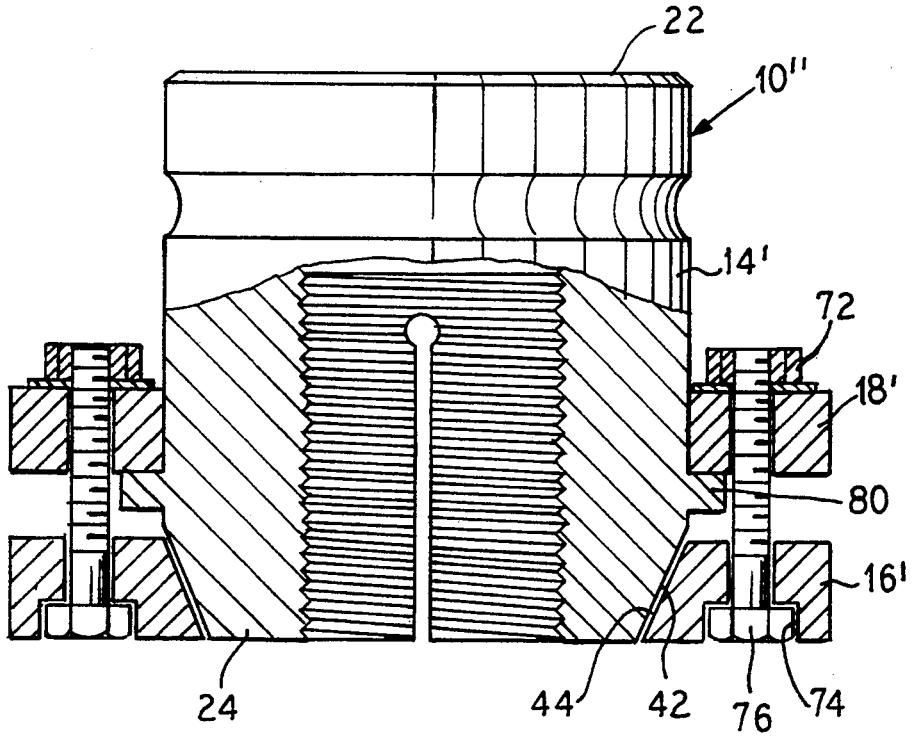
FIG. 5 is a sectional view of a second alternate embodiment of the present invention.

FIG. 5 illustrates a further embodiment of a tool 10″ having a first sleeve 14′ which provides an annular integral flange 80 which retains a third sleeve 18′ in axial position on the first sleeve 14′ at a minimum axial distance from the second end 24. In this embodiment, by drawing the nut 72 tight, the second sleeve 16′ is drawn toward the fixed-in-place third sleeve 18′, thus the tapered inside diameter 44 slides against the tapered outside diameter 42 of the first sleeve 14′ thereby drawing the first sleeve 14′ into a collapsed condition on a rod (not shown). Once the first ring 14′ tightly seizes the rod, the tool 10″ can be rotated as described in the previous embodiment or in a known fashion such as described in U.S. Pat. No. 5,253,556.

One advantage of the present invention in the embodiments shown in FIG. 1 through FIG. 5 is that a threading of a ring on an outside of the first sleeve 14, 14′ is not required. The second and third rings in these embodiments simply slip onto an outside plain surface of the first ring 14. Thus, the tool is less time consuming to install and the need to protect outside threads from damage is avoided. A machining of threads on an outside of the first sleeve is also avoided resulting in a less costly manufactured tool.

Although the present invention has been described with reference to a specific embodiment, those of skill in the art will recognize that changes may be made thereto without departing from the scope and spirit of the invention as set forth in the appended claims.

We claim as our invention:

1. A tool for gripping a threaded end of a rod, comprising:

a first sleeve having means applied on an inside diameter thereof for frictionally gripping said rod, said first sleeve having an open end for receiving an end of said rod into the first sleeve, said first sleeve having a first annular surface around its outer diameter angled from an axis of said first sleeve and adjacent its open end, said surface inclined to an increasing diameter away from said open end;

a second sleeve encircling said first sleeve around said first annular surface, said second sleeve having an inside surface in contact with said first annular surface; and means for drawing said second sleeve axially in a direction away from said open end to cause said inside surface of said second sleeve to slide on said first annular surface of said first sleeve, said means braced against said first sleeve to resist axial movement of said means during said drawing of second sleeve said means for drawing comprising a plurality of threaded fasteners having axes offset from an axis of said first sleeve; and means allocated to said first sleeve for allowing collapsing of said first sleeve onto said rod to tightly grip said rod when said second sleeve is drawn by said means for drawing.

2. The tool according to claim 1 wherein said inside surface of said second sleeve has an inclination to slide flushly on said first annular surface.

3. The tool according to claim 1 wherein said means for allowing collapsing comprises a plurality of axially arranged slots through said first sleeve having slot open ends at said open end of said sleeve and closed end toward an opposite end of said first sleeve.

4. A tool for gripping a threaded end of a rod, comprising:

a first sleeve having means applied on an inside diameter thereof for frictionally gripping said rod, said first sleeve having an open end for receiving an end of said rod into the first sleeve, said first sleeve having a first annular surface around its outer diameter angled from an axis of said first sleeve and adjacent its open end, said surface inclined to an increasing diameter away from said open end;

a second sleeve encircling said first sleeve around said first annular surface, said second sleeve having an inside surface in contact with said first annular surface; and means for drawing said second sleeve axially in a direction away from said open end to cause said inside surface of said second sleeve to slide on said first annular surface of said first sleeve, said means braced against said first sleeve to resist axial movement of said means during said drawing of second sleeve; and means allocated to said first sleeve for allowing collapsing of said first sleeve onto said rod to tightly grip said rod when said second sleeve is drawn by said means for drawing wherein said means for drawing comprises a third sleeve surrounding said first sleeve, said first sleeve having a second annular surface angled from said axis of said first sleeve in an opposite inclination to said first annular surface; and a plurality of fasteners arranged around the perimeter of said second and third sleeves, spanning between said second and third sleeves, and tightenable to progressively draw said second sleeve toward said third sleeve.

5. The tool according to claim 4 further comprising at least one jack bolt threaded into said third sleeve and abutting a surface of said second sleeve facing said third sleeve.

6. A tool for gripping a threaded end of a rod, comprising:

a first sleeve having means applied on an inside diameter thereof for frictionally gripping said rod, said first sleeve having an open end for receiving an end of said rod into the first sleeve, said first sleeve having a first annular surface around its outer diameter angled from an axis of said first sleeve and adjacent its open end, said surface inclined to an increasing diameter away from said open end;

a second sleeve encircling said first sleeve around said first annular surface, said second sleeve having an inside surface in contact with said first annular surface; and means for drawing said second sleeve axially in a direction away from said open end to cause said inside surface of said second sleeve to slide on said first annular surface of said first sleeve, said means braced against said first sleeve to resist axial movement of said means during said drawing of second sleeve; and means allocated to said first sleeve for allowing collapsing of said first sleeve onto said rod to tightly grip said rod when said second sleeve is drawn by said means for drawing wherein said means for drawing comprises a third sleeve surrounding said first sleeve and fixed at a minimum axial distance to said open end of said first sleeve; and a plurality of fasteners arranged around the perimeter of said second and third sleeves and axially connecting said second and third sleeves, drawing tight of said fasteners draws said second sleeve toward said third sleeve.

7. The tool according to claim 6 wherein said third sleeve is separate from said first sleeve;

and said first sleeve comprises an annular flange arranged fixed thereto between said third sleeve and said second sleeve, an axial position of said annular flange setting the minimum axial distance of said third sleeve to said open end of said first sleeve.

8. A tool for gripping a rod, comprising:

a first sleeve having means applied on an inside diameter thereof to grip said rods, said first sleeve having an open end for receiving an end of said rod into the first sleeve, the first sleeve having a first surface extending axially from near to said open end toward an opposite end outwardly, obliquely to a crest, and a second surface extending axially from near to said crest toward said opposite end inwardly obliquely, and at least one axial slot allowing said first sleeve to be partially collapsed radially;

a second sleeve surrounding said first sleeve, said second sleeve having a tapered inside surface flushly abutting said first surface;

a third sleeve surrounding said first sleeve, said third sleeve having a tapered inside surface flushly abutting said second surface; and a means for drawing said second sleeve toward said third sleeve to force said tapered inside surfaces of said second and third sleeves to slide on said first and second surfaces to partially collapse said first sleeve.

9. The tool according to claim 8 wherein said first and second surfaces are substantially annular surfaces intersected by said at least one axial slot.

10. The tool according to claim 9 wherein said at least one axial slot comprises a plurality of slots angularly spaced around a perimeter of the first sleeve, extending axially from said open end of said first sleeve to a position between said second surface and said opposite end.

11. The tool according to claim 8 wherein said means for drawing comprises a plurality of threaded fasteners arranged axially, connecting said second and third sleeves.

12. The tool according to claim 8 further comprising a means applied between said second and third sleeves for forcing said second and third sleeves apart to loosen said tool from said rod.

13. The tool according to claim 12 wherein said means for forcing comprises a jack bolt threaded into a threaded bore of said third sleeve and abutting said second sleeve.

14. A tool for gripping a rod, comprising:

a first sleeve having means applied on an inside diameter thereof to grip said rods, said first sleeve having an open end for receiving an end of said rod into the first sleeve, the first sleeve having an inclined surface extending axially from near to said open end toward an opposite end outwardly, obliquely to a crest, and at least one axial slot allowing said first sleeve to be partially collapsed radially;

a second sleeve surrounding said first sleeve, said second sleeve having a tapered inside surface flushly abutting said inclined surface;

a third sleeve surrounding said first sleeve, said third sleeve fixed in axial position on said first sleeve in a direction toward said second sleeve; and a means for drawing said second sleeve toward said third sleeve to force said tapered inside surfaces of said second sleeve to slide on said inclined surface to partially collapse said first sleeve.

15. The tool according to claim 14 wherein said inclined surface is a substantially annular surface intersected by said at least one axial slot.

16. The tool according to claim 15 wherein said at least one axial slot comprises a plurality of slots angularly spaced around a perimeter of the first sleeve, extending axially from said open end of said first sleeve to a position between said inclined surface and said opposite end.

17. The tool according to claim 14 wherein said means for drawing comprises a plurality of threaded fasteners arranged axially, connecting said second and third sleeves.

* * * * *